United States Patent [19]

Kintish

[11] 4,014,265

[45] Mar. 29, 1977

[54] VEHICLE INCAPACITATOR

[75] Inventor: Irving L. Kintish, Rockaway, N.J.

[73] Assignee: The United States of America as represented by the Secretary of the Army, Washington, D.C.

[22] Filed: Oct. 5, 1964

[21] Appl. No.: 410,050

[52] U.S. Cl. ..... 102/70 S; 102/79

[51] Int. Cl.[2] ..... F42C 15/22

[58] Field of Search ..... 102/70, 79, 1, 70 S, 102/80; 116/33, 83, 89, 116

[56] References Cited

UNITED STATES PATENTS

| | | | |
|---|---|---|---|
| 1,275,330 | 8/1918 | Wagner | 116/33 |
| 1,435,969 | 11/1922 | Marcotte | 116/89 |
| 2,750,889 | 6/1956 | Kuhn | 102/79 |
| 2,798,432 | 7/1957 | Meister | 102/79 |
| 3,107,618 | 10/1963 | Vanover | 102/70 |

FOREIGN PATENTS OR APPLICATIONS

| | | | |
|---|---|---|---|
| 48,989 | 7/1934 | Denmark | 102/80 |
| 813,728 | 6/1937 | France | 102/80 |

*Primary Examiner*—David H. Brown

*Attorney, Agent, or Firm*—Nathan Edelberg; Robert P. Gibson; A. Victor Erkkila

EXEMPLARY CLAIM

1. A vehicle incapacitator comprising
   a rotatable body of cast explosive having at least one cavity therein,
   a container seated in said cavity and having a flexible sidewall construction, said sidewall having an opening,
   a detonator within said container contacting said explosive,
   a firing pin having a conical forward surface for initiating said detonator, and
   means normally engaging said forward surface larger than said opening and for preventing said firing pin from initiating said detonator until a predetermined centrifugal force is imparted to said preventing means to thereby laterally displace said preventing means through said opening and release said firing pin to impinge on and initiate said detonator.

2 Claims, 4 Drawing Figures

Fig. 1
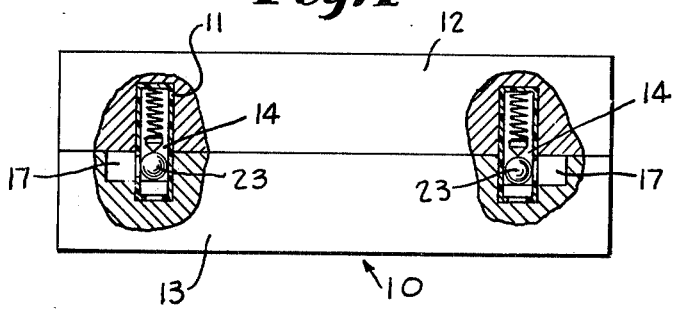
Fig. 2
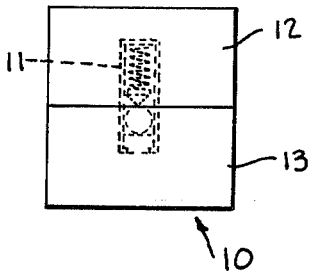
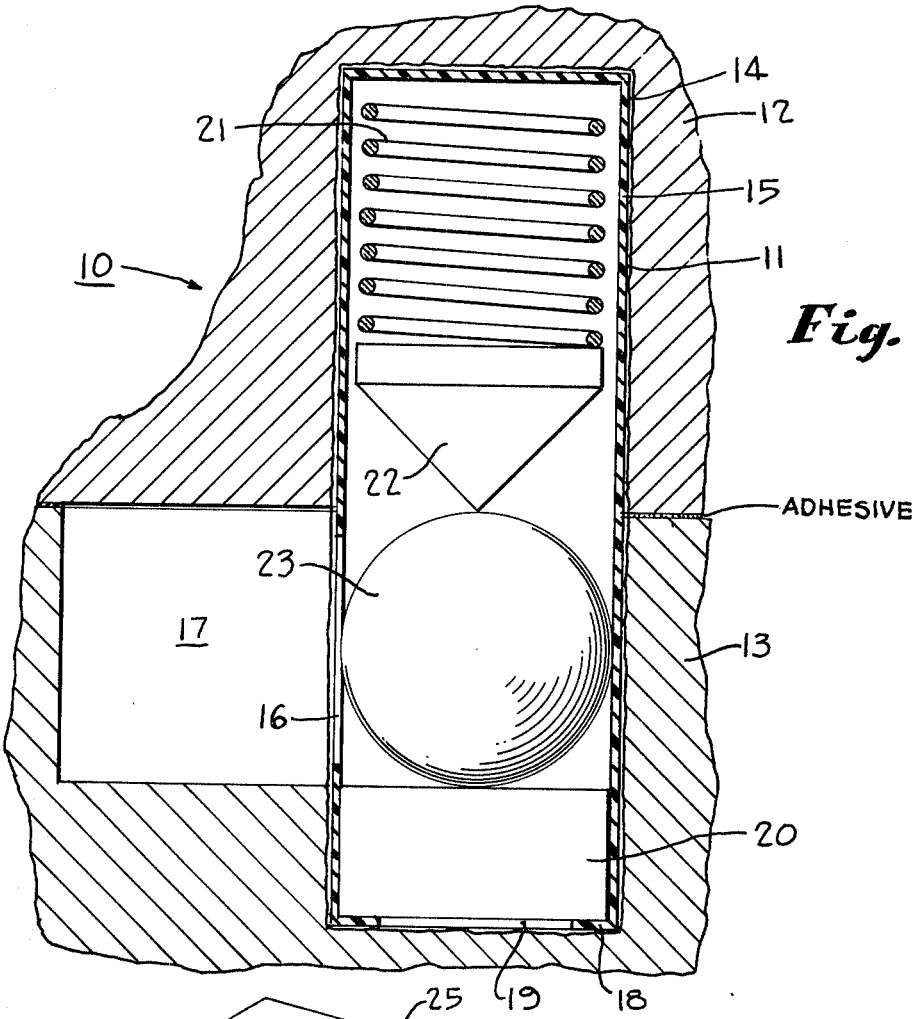
Fig. 3
Fig. 4
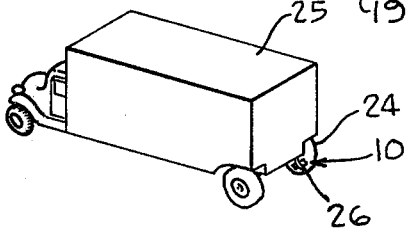
INVENTOR.
IRVING L. KINTISH
BY: Harry M. Saragovitz, Edward J. Kelly, Herbert Berl & S. Dubroff
ATTORNEYS.

VEHICLE INCAPACITATOR

The invention described herein may be manufactured and used by or for the Government for governmental purposes without the payment to me of any royalty thereon.

This invention relates to a sabotage device and particularly to a sabotage device for use as a vehicle incapacitator. More particularly, the invention relates to a sabotage device which is detonated by the centrifugal action of a spinning wheel to which it is attached.

Devices heretofore used to sabotage vehicles required installation in the ignition or braking systems. These devices were inadequate since they took considerable time to install and were readily detectable upon casual examination. Furthermore the device used was generally detonated at or near the point of installation which could preclude the time delay necessary to permit escape of the saboteur. The old devices had the added disadvantage of relatively expensive construction, along with having the capability of the reconstruction of the parts after detonation.

It is, therefore, an object of the present invention to provide a low cost vehicle incapacitator which is capable of simple attachment to the wheel of a vehicle in such a manner that it will not be readily detected upon casual examination.

It is a further object of this invention to provide a vehicle incapacitator that uses parts which are incapable of complete reconstruction after detonation of the device.

In accordance with the invention at least one spring loaded initiator is placed in a cavity within a "soap cake" shaped cast explosive. The initiator comprises a container having opposite open and closed ends and a radial opening generally centrally located. A detonator is contained in the open end portion and a spring biased firing pin is located in the closed end portion of the container. A ball bearing is disposed in the container between the detonator and the firing pin and in alignment with the radial opening. The firing pin and the detonator frictionally hold the ball bearing from moving out of the container through the opening. The "soap cake" explosive is bonded to the back portion of a vehicle wheel with a suitable adhesive. When the vehicle is mobilized the centrifugal action of the spinning wheel develops a force which overcomes the friction force of the firing pin and detonator on the ball bearing resulting in an outward movement of the ball bearing through the radial opening of the container. This renders the firing pin free to move under the urging of the spring. Thus, the firing pin impinges and initiates the detonator, resulting in detonation of the explosive and finally incapacitation of the vehicle.

The invention will, however, be further understood from the following description, when considered in connection with the accompanying drawings, and its scope is pointed out in the appended claims.

In the drawings:

FIG. 1 is a view in elevation and partly in cross-section of a vehicle incapacitator embodying the invention;

FIG. 2 is an end view of the vehicle incapacitator of FIG. 1 showing further details of construction;

FIG. 3 is an enlarged portion of FIG. 1 showing further details of construction;

FIG. 4 shows a vehicle incapacitator of the present invention arranged in an operative position.

Referring to the drawings in which like reference characters refer to like parts throughout the various figures, 10 is a "soap cake" shaped body of cast explosive material having two like cavities 11 situated at opposite end portions thereof. The explosive 10 is comprised of upper section 12 and a lower section 13 longitudinally bonded to each other by a suitable adhesive.

Each cavity 11 contains a detonator initiating device 14 comprising a yieldable plastic-like hollow cylindrical container 15 having an upper closed end and a lower opened end. At a substantially central point the container 15 has a radial opening 16 which communicates with a pocket 17 in each of the cavities 11, the pockets 17 extending towards the ends of the explosive 10.

The lower end of the container 15 is provided with an integral inwardly directed flange 18 which defines an opening 19 having a diameter smaller than the internal diameter of the container 15. Disposed in the lower end portion of the container 15 and in substantial abutting relation with the flange 18 is a detonator 20. The detonator 20 sufficiently contacts the explosive 10 through the opening 19 so that upon initiation of the detonator 20 the detonation of the explosive 10 will follow.

A helical spring 21 biased firing pin 22 is disposed in the upper end portion of the container 15. The firing pin 22 is adapted to slide freely within the container 15 under the urging of the spring 21 which provides sufficient force and length to allow the firing pin 21 to impinge on and initiate the detonator 20.

A steel ball 23 is disposed in the container 15 between the firing pin 22 and the detonator 20 and in substantially abutting relationship with both. The ball 23 is aligned with the opening 16 and pocket 17 and has a diameter slightly larger than that of the opening 16. The undersized opening 16 will prevent the ball 23 from inadvertently falling out. A diaphram (not shown) may be placed over the opening 16 to perform the same function. The spring 21 urges a force through the firing pin 22 to the ball 23 and ultimately to the detonator 20. The force of the spring 21 acting on the ball 23 is of a magnitude sufficient to hold the ball 23 in a fixed relationship as described until it is overcome by a predetermined centrifugal force imparted to the ball 23 in the direction of the pocket 17. This centrifugal force will be sufficient to cause the ball 23 to be displaced through the undersized opening 16 in the yieldable, plastic-like wall of container 15, thereby freeing the firing pin 22 to move downwardly to impinge on and initiate the detonator 20.

In operation the explosive 10 is bonded to the back of a wheel 24 of a vehicle 25 by means of a suitable adhesive 26. When the vehicle becomes mobilized and reaches a predetermined forward speed the centrifugal force imparted to the initiator 14 as a result of the rotating wheel overcomes the spring 21 force on the balls 23 causing the balls to be displaced into the cavities 17. This allows the firing pin 23 to move downwardly under the urging force of the spring 21. The firing pins 23 impinge on the detonators 20 which will initiate and detonate the explosives resulting in damage to the wheel and incapacitation of the vehicle.

I claim:

1. A vehicle incapacitator comprising a rotatable body of cast explosive having at least one cavity therein, a container seated in said cavity and having a flexible sidewall construction, said sidewall having an opening, a detonator within said container contacting said explosive, a firing pin having a conical forward surface for initiating said detonator, and means larger than said opening and normally engaging said forward surface for preventing said firing pin from initiating said detonator until a predetermined centrifugal force is imparted to said preventing means to thereby laterally displace said preventing means through said opening and release said firing pin to impinge on and initiate said detonator.

2. A vehicle incapacitator comprising a rotatably mounted body of cast explosive having at least one cavity therein, a cylindrical container fixedly seated in said cavity and having a flexible sidewall construction, said sidewall having an opening said container having opened and closed opposite ends, and a radial opening in said container sidewall and generally centrally located communicating with a pocket within said body of explosive, a detonator within said container at the open end portion thereof contacting said explosive, a spring biased firing pin at the closed end of said container, said pin having a conically shaped forward surface, a ball larger than said sidewall radial opening disposed between said detonator and said firing pin forward surface and aligned with said container radial opening whereby said ball will be displaced through said container radial opening and into said pocket within said body of explosive when a predetermined centrifugal force is imparted to said ball thereby, laterally displacing said ball through said opening and releasing said firing pin to impinge on and initiate said detonator.

* * * * *